US005211028A

United States Patent [19]

Remo

[11] Patent Number: 5,211,028

[45] Date of Patent: May 18, 1993

[54] DEVICE FOR THE CLEANING OF THE CONDENSOR OF A REFRIGERATING OR CONDITIONING UNIT OR PLANT

[76] Inventor: Dall'Anese Remo, Via Garibaldi, 114, Pietrasanta, Lucca, Italy

[21] Appl. No.: 753,345

[22] Filed: Aug. 30, 1991

[51] Int. Cl.[5] ..... F28G 15/02; F28G 7/00

[52] U.S. Cl. ..... 62/303; 165/94; 165/95

[58] Field of Search ..... 62/303; 165/94, 95; 74/491, 503

[56] References Cited

U.S. PATENT DOCUMENTS

| | | | |
|---|---|---|---|
| 551,272 | 12/1895 | Fales | 165/95 |
| 1,441,431 | 1/1923 | Kirgan | 165/95 |
| 1,483,460 | 2/1924 | Linaker et al. | 165/95 X |
| 1,978,555 | 10/1934 | Snow | 165/95 |
| 2,033,402 | 3/1936 | Smith | 165/95 |
| 4,497,363 | 2/1985 | Heronemus | 165/95 |

FOREIGN PATENT DOCUMENTS

| | | | |
|---|---|---|---|
| 8600696 | 1/1986 | PCT Int'l Appl. | 165/94 |

*Primary Examiner*—Harold Joyce
*Assistant Examiner*—William C. Doerrler
*Attorney, Agent, or Firm*—McGlew and Tuttle

[57] ABSTRACT

The cleaning of the condensor of a refrigerating or conditioning unit or plant including a condensor of the refrigerant fluid, with a coil, a finning, and an exhaust fan are performed by a brush horizontal mounted on a support that slides vertically in front of the condensor, in its entire height, from the opposed side respect the aspirator, in two corresponding guides and in the way that the bristles can pass in the interstices of the finning skimming this and the coil; and a driving lever or motor for the movement of the above mentioned support with an alternative motion in the above mentioned vertical guides.

9 Claims, 6 Drawing Sheets

DEVICE FOR THE CLEANING OF THE CONDENSOR OF A REFRIGERATING OR CONDITIONING UNIT OR PLANT

FIELD OF THE INVENTION

The present invention relates to a device for the cleaning of the condensor of a refrigerating or conditioning unit or plant.

BACKGROUND OF THE INVENTION

It's known that radiators of heat exchangers, refrigerating or freezing units or plants, either domestic or industrial, include a condensor of the refrigerant fluid. The condensor is positioned in a vertical position and is associated with an ambient air exhauster situated at the lower end of the condensor. In this way the aspirated air frontally meets the coil and the finning of the condensor and is useful for the draining of the heat produced by the compressor.

As time passes the dust from the aspirated air, deposits itself and accumulates in the interstices or crevices of the above mentioned finning until it clogs them completely. This causes a rise of pressure of the refrigerant fluid to which follows the overheating of the compressor, which after a short time, causes the compressor to break down. This fact causes the arrest of the refrigerator or the conditioning plant with evident and also economic damage. Also this causes the deterioration of the kept materials as in the case of the foodstuffs and pharmaceutical products.

SUMMARY AND OBJECTS OF THE INVENTION

The present invention proposes the aim to eliminate the above mentioned troubles. This result is accomplished in conformity with the invention by adopting the idea to periodically remove the dust that deposits itself between the fins and the coil of the condensor. This is done by using a brush mounted on a support that slides along two vertical guides and horizontally extends for all the breadth of the condensor. The bristles of the brush are able to reach the coil, and movement of the support of the above mentioned brush is with an alternative vertical movement.

Bearing in mind that the operation of brushing is useful only desultorily, or occasionally, according to a form of a simplified embodiment, the means of movement of the support of the brush are formed by a hand lever. The hand lever is hinged on one of the above mentioned vertical guides or, in alternative, by a handle directly fixed on the top of the support of the brush. To realize an automatic device, especially where the condensor or the radiator are in a position that is not easily accessible, the means of movement of the brush/es are formed by a slotted link mechanism with a crank mounted on a shaft of an electric motor. A link is hinged respectively to the crank and to the support of the brush/es. Advantageously, the above mentioned electric motor is controlled by a timer or by a thermostat, to effect, in an automatic way, one or more cleanings of the condensor, or similarly, with a predetermined frequency. More simply the electric motor can be started with a push-button.

The solution suggested by the present invention makes it possible to easily and in a sure way effect the cleaning of the condensor or radiator, automatically, and with a limited cost that is amply compensated for by a surer and more reliable nonstop working of the compressor for long periods.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
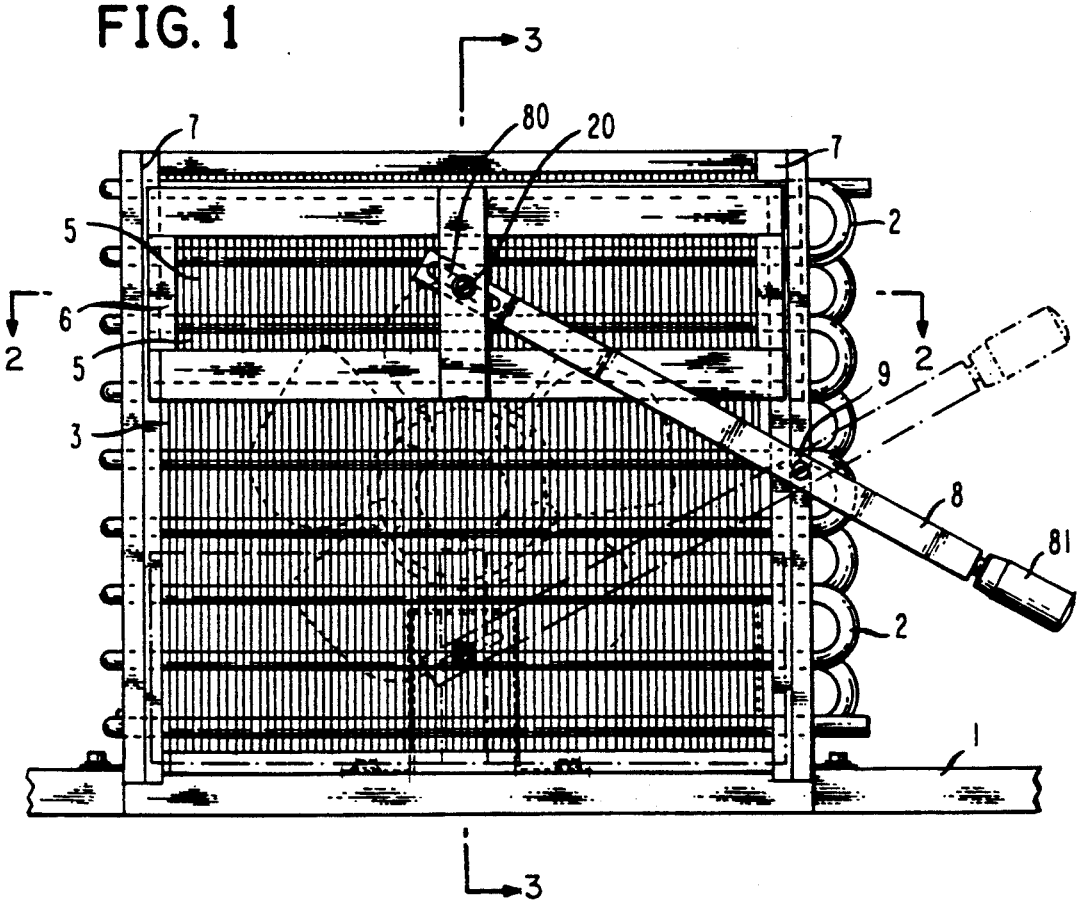
FIG. 1 represents the frontal view of a manual version of a device for the cleaning of the condensor of a refrigerating unit, in conformity with the invention.
Figure 2:
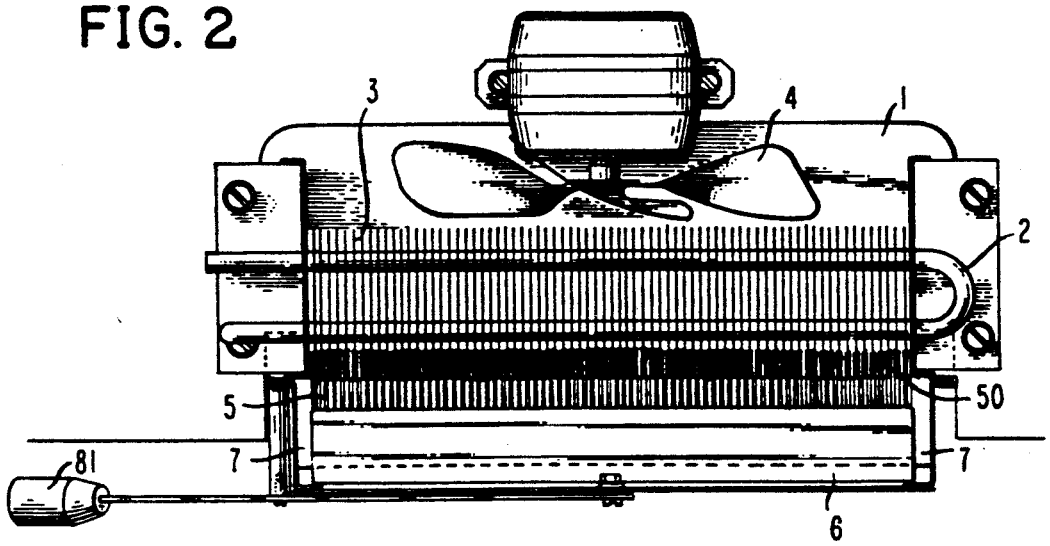
FIG. 2 represents the section according to 2—2 of FIG. 1.
Figure 3:
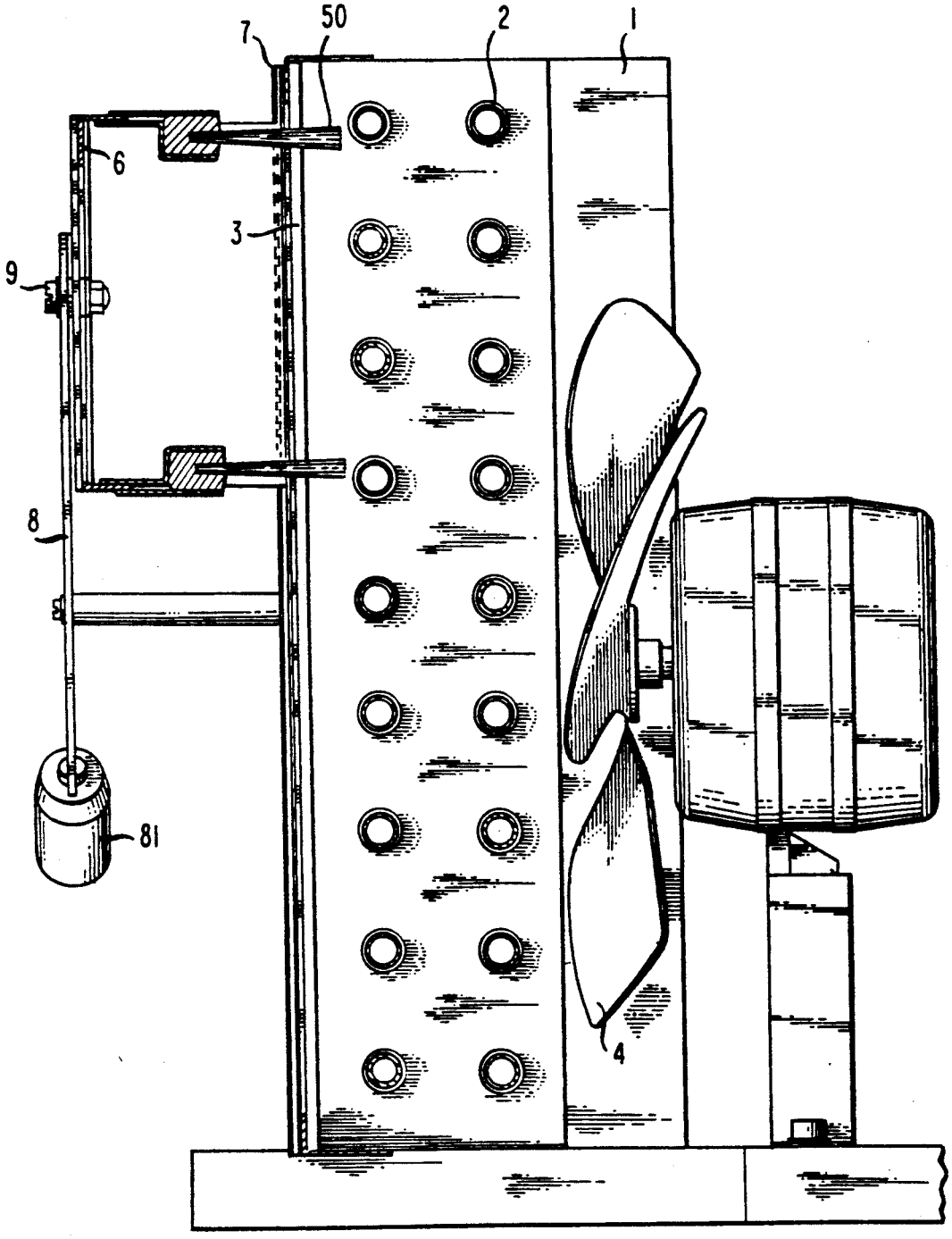
FIG. 3 represents the section according to 3—3 of FIG. 1.
Figure 4:
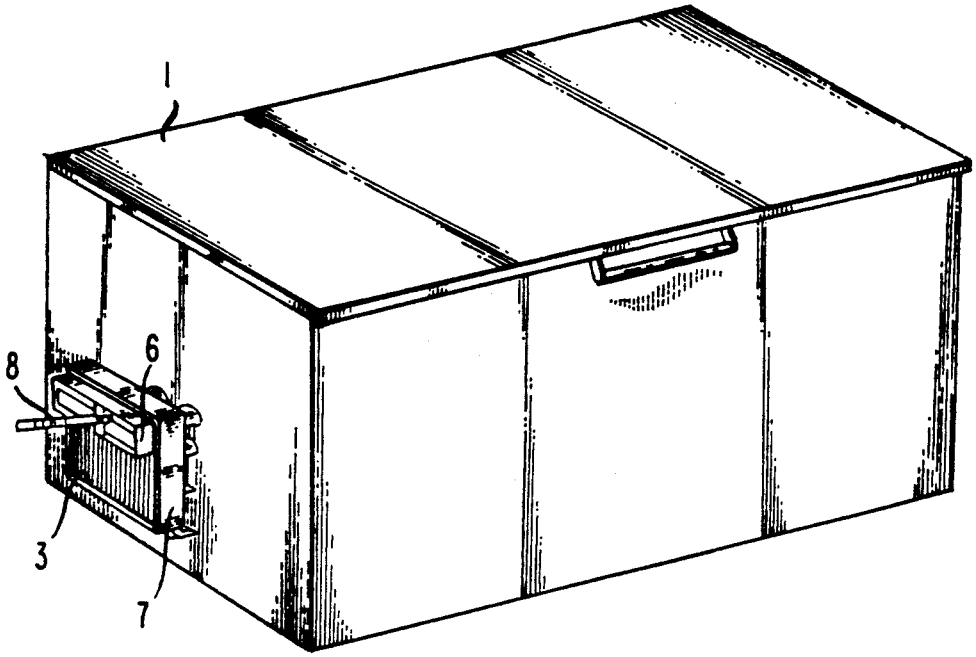
FIG. 4 represents the external view of the whole refrigerating unit provided with the device of FIG. 1.
Figure 8:
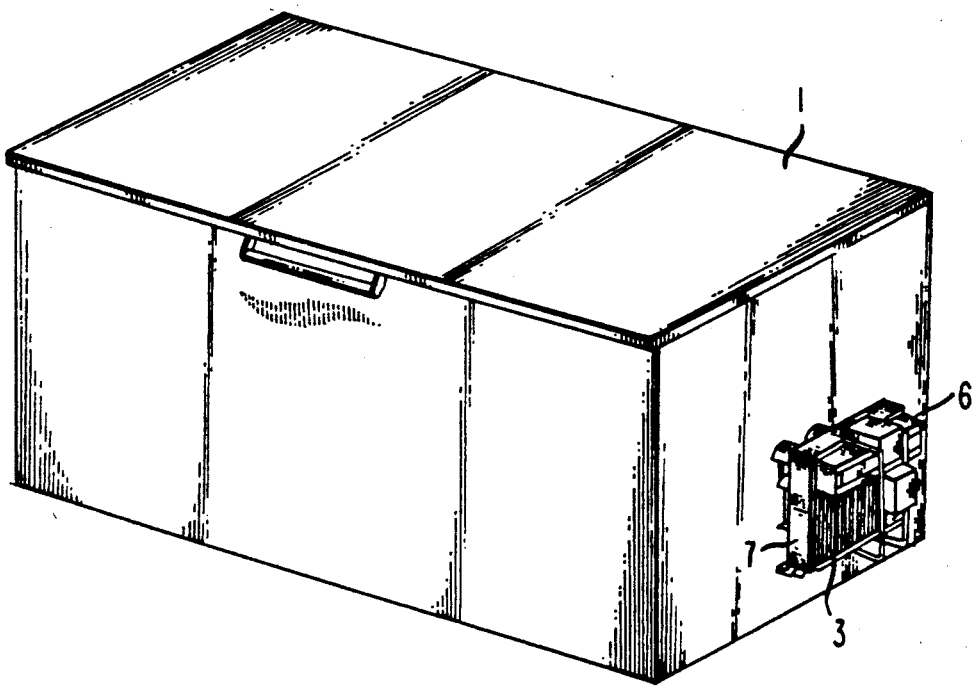
FIG. 8 represents the whole view of a unit provided with the device of FIG. 5.
Figure 5:
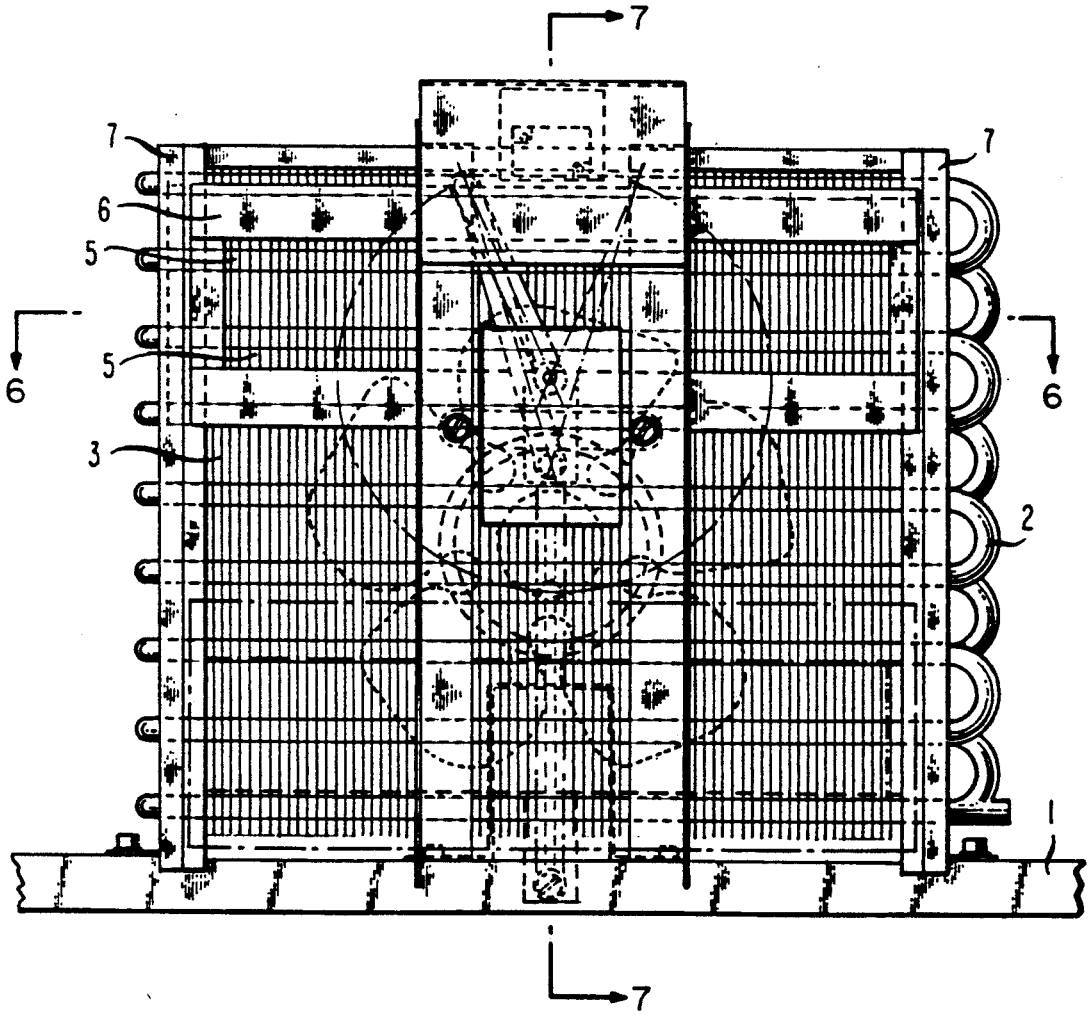
FIG. 5 represents the frontal view of a mechanized and automatic version of a device for the cleaning of the condensor in conformity with the invention.
Figure 6:
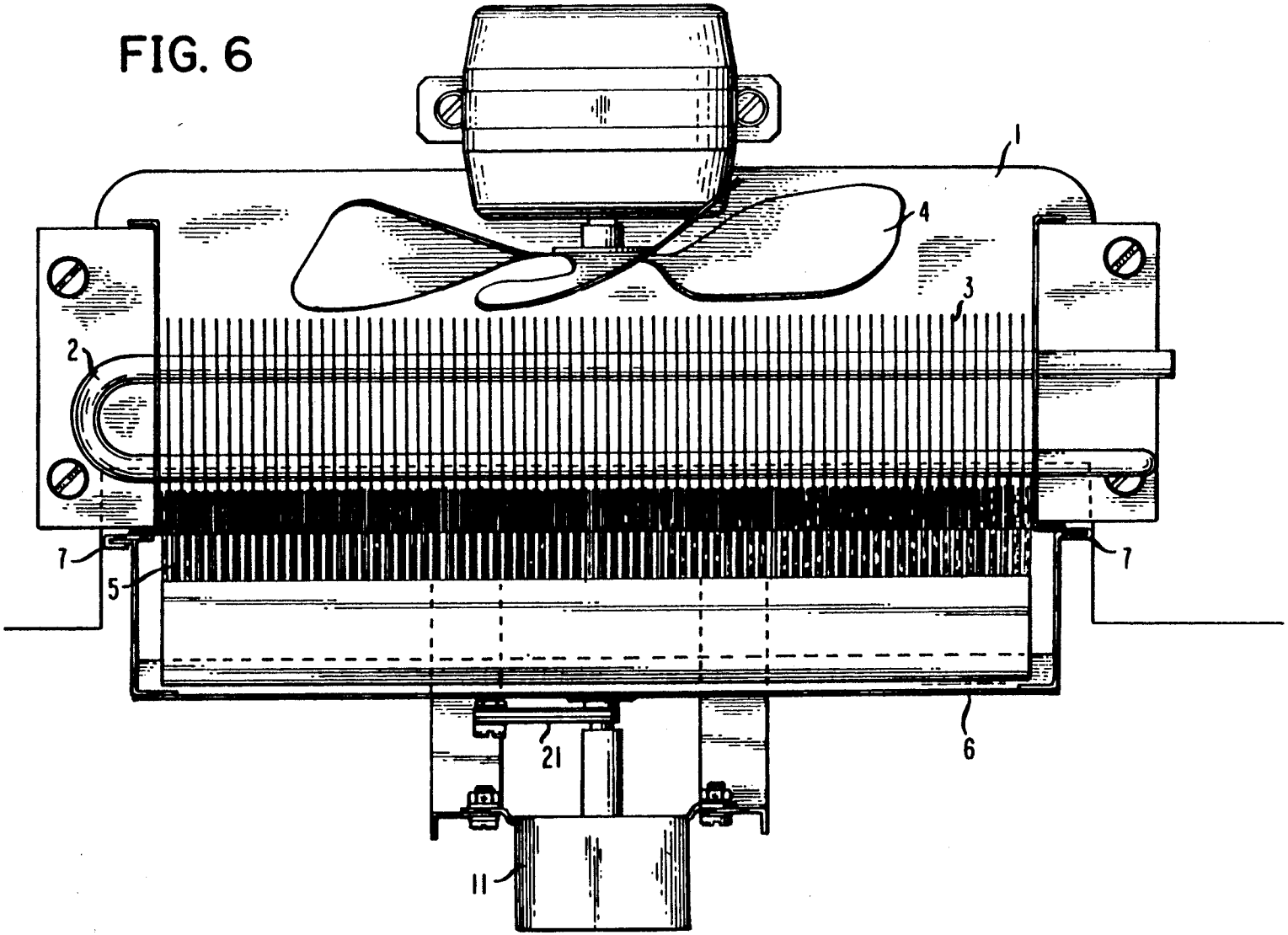
FIG. 6 represents the section according to 6—6 of FIG. 5.
Figure 7:
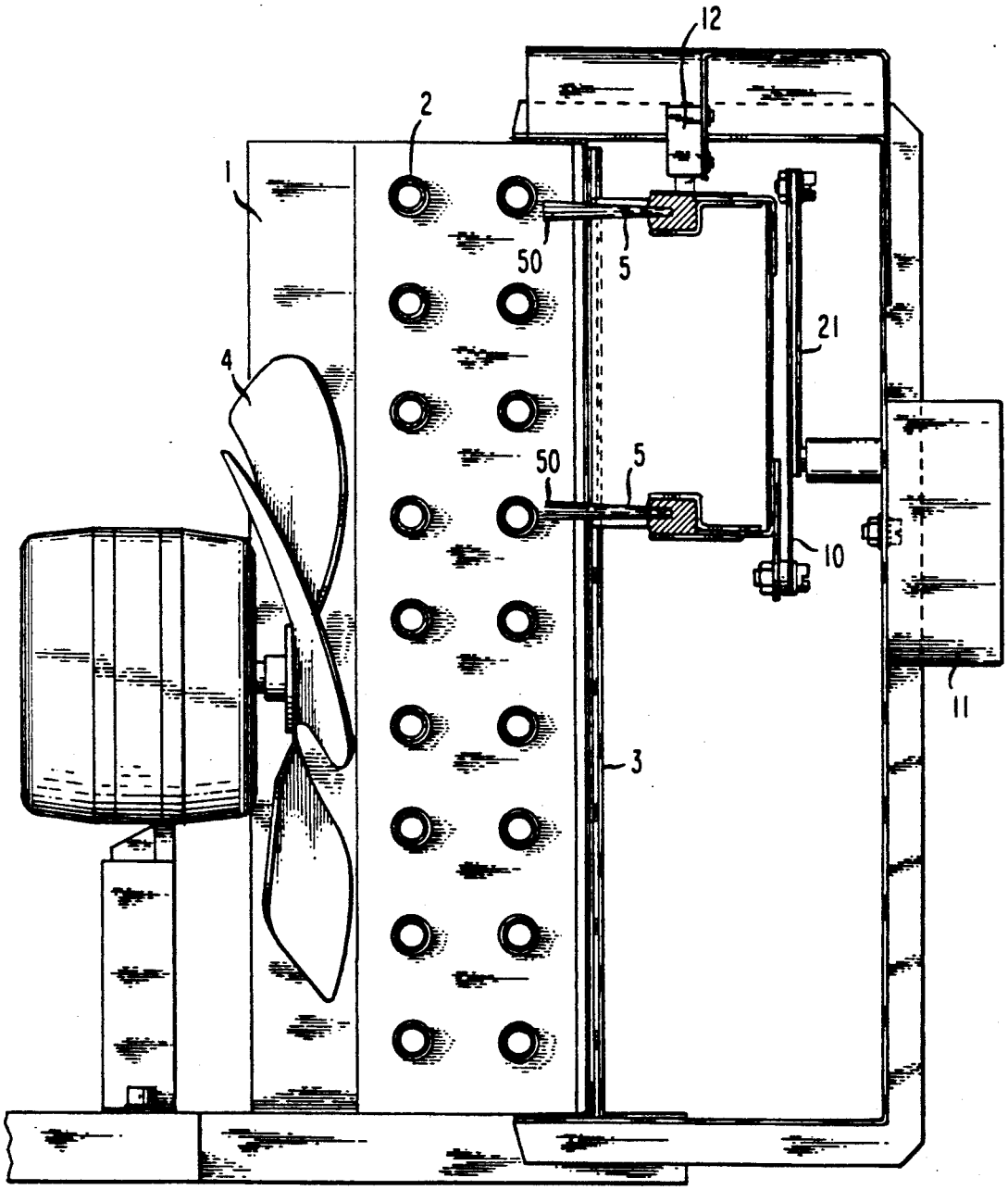
FIG. 7 represents the section according to 7—7 of FIG. 5.

Limited to its essential structure and referring to the FIGS. from 1 to 4 of the annexed drawing, a manual device, according to the invention, for the cleaning of the condensor of a refrigerating unit 1 with a coil 2, fins 3 and an exhaust fan 4, includes:

two brushes 5 horizontally fixed and vertically spaced apart on a brush support 6, the support 6 is vertically sliding in front of the condensor on the opposite side of the exhaust fan 4, the sliding of support 6 is in two corresponding vertical guides 7, fixed in correspondence with the sides of the condensor, for its entire height: the above mentioned brushes 5, are at such a distance from the condensor so that the bristles 50, with their vertical movement ar introduce in the interstices of the fins 3 until they skim the coil 2;

a drive lever 8 with the pin of a hinge 9 is fixed to a fixed part of the refrigerator 1 and at approximately at half the height of the guides 7, the drive lever 8 is provided with an extremity having slipping means which is made up of a longitudinal slotted hole 80 for the guide of a brush support pin 20 fixed in the center of the support 6 of the brushes 5, the other extremity of lever 8 stretches out from the body of the refrigerator 1 and is provided with a grip 81 for driving. The vertical driving of the lever 8 enables the vertical alternative movement of the support 6 and therefore the bristles 50 of the brushes slide between the interstices of the fins 3, and on the coil 2, to remove the inevitable dust and foreign bodies that accumulate here.

With reference to the figures from 5 to 8 of the drawings, a mechanized and automatic device for the cleaning of the condensor 2–4 of a refrigerating unit 1 according to the invention, includes:

two brushes 5 with support 6 sliding in vertical guides 7;

a device for the automatic movement of the above mentioned support 6, including a slotted link mechanism, with a crank or first link 21 fixedly mounted on the shaft of an horizontal electric motor 11 and oriented perpendicularly and in front of the condensor, a second link 10 is hinged respectively, to a free extremity of the above mentioned crank 9 and in the center of the support 6 of the brushes 5.

The motor 11 makes the crank 9 rotate. Each complete vertically moves the support 6 and the brushes 5 up and down a distance equal to the height of the condensor.

Advantageously the device is provided with a switch 12 at an end of the support 6 and with a timer or with a thermostat (not represented). The switch 12 directs, in predetermined periods of time, one or more cycles of cleaning. As a substitute for or additionally to the timer, a push button is foreseen for the manual start of the electric motor 11.

In practice the details of execution can however change in a way equivalent to the form, dimensions, disposition of the elements, nature of the used materials without moreover leaving from the ambit or confines of the adopted idea of solution and so remaining within the limits of the granted tutelage accorded by the present patent for industrial invention.

I claim:

1. A manual cleaning device for cleaning fins of a condenser of a refrigeration unit, the device comprising:

a first guide mounted on one side of the condensor and a second guide mounted on an opposite side of the condensor from said first guide, said first and second guide being aligned substantially in parallel with the fins of the condensor;

a brush support extending from said first guide to said second guide, said brush support including slide means for connecting said brush support to said first and second guides and for sliding said brush support in said first and second guides along a length of the condensor in a direction substantially parallel with the fins;

a brush mounted on said brush support and extending onto said in between the fins for cleaning the fins;

a drive lever pivotably mounted on the condensor with a drive lever pin, said drive lever pin being positioned between first and second side of said drive lever, said drive lever pin positioning said first end of said drive lever on said brush support and positioning said second end away from the condensor for manual activation of the lever; and slipping means, connecting said drive lever to said brush support, and for converting pivotable movement of said first end of said drive lever into linear movement of said brush support in said direction substantially parallel to the fins, said linear movement moving said bush along the fins and removing dirt from between the fins.

2. A device in accordance with claim 1, further comprising:

an exhaust fan on one side of the condensor, said one side of the condensor being substantially opposite said first and second guides, said brush support and said drive lever.

3. A device in accordance with claim 1, wherein:

said brush is divided into first and second rows at opposite sides of said brush support in said direction of the fins, said brush support defining openings between said first and second rows of said brush.

4. A device in accordance with claim 1, wherein:

said drive lever pin is mounted on said first guide.

5. A device in accordance with claim 1, wherein:

said slipping means includes a brush support pin mounted on said brush support, and a slide hole defined by said first end of said drive lever, said brush support pin being slidably positioned inside said slide hole.

6. A device in accordance with claim 1, wherein:

said brush support slides along an entire length of the condensor, and said drive lever moves said brush support in alternate opposite directions;

said drive lever pin is mounted approximately at a center of said length of the condensor;

said second end of said drive lever has a hand grip means for gripping with a hand.

7. A motorized cleaning device for cleaning fins of a condenser of a refrigeration unit, the device comprising:

a first guide mounted on one side of the condensor and a second guide mounted on an opposite side of the condensor from said first guide, said first and second guide being aligned substantially in parallel with the fins of the condenser, a brush support extending from said first guide to said second guide, said brush support including slide means for connecting said brush support to said first and second guides and for sliding said brush support in said first and second guides along a length of the condensor in a direction substantially parallel with the fins;

a brush mounted on said brush support and extending onto and in between the fins for cleaning the fins;

a motor mounted on to said condensor; and a linkage means, connecting said motor to said brush support, and for converting rotational movement of a shaft of said motor into linear movement of said brush in said direction substantially parallel to the fins, said linear movement moving said brush along the fins and removing dirt from in between the fins, said linkage means including a first link, said first link has a first end rigidly connected to said shaft of said motor, said linkage means also includes a second link, said second link has a first end pivotally connected to said brush support, said second link also having a second end pivotally connected to a second end of said first link, said first and second links having separate lengths of a size for said converting of said rotational movement of said shaft into said linear movement of said brush support.

8. A device in accordance with claim 7, further comprising:

switch means for activating and deactivating said motor, said switch means being selected from the group consisting of a timer, a thermostat, a pressure switch and a push-button switch.

9. A device in accordance with claim 1, wherein:

said brush cleans an external surface of the fins of the condensor.

* * * * *